US006062962A

United States Patent [19]

Lupi

[11] Patent Number: 6,062,962

[45] **Date of Patent: *May 16, 2000**

[54] BENCH FOR MACHINING ELONGATE OBJECTS SUCH AS STRIPS OF MARBLE AND THE LIKE

[76] Inventor: Quintilio Lupi, 7 Kings Road, London, United Kingdom, NW10 2BL

[ * ] Notice: This patent is subject to a terminal disclaimer.

[21] Appl. No.: 09/297,512

[22] PCT Filed: Nov. 18, 1997

[86] PCT No.: PCT/IT97/00284

§ 371 Date: May 3, 1999

§ 102(e) Date: May 3, 1999

[87] PCT Pub. No.: WO98/22258

PCT Pub. Date: May 28, 1998

[30] Foreign Application Priority Data

Nov. 22, 1996 [IT] Italy ..... RM96A0798

[51] Int. Cl.[7] ..... B24B 47/00

[52] U.S. Cl. ..... 451/388; 125/35; 269/21; 269/303; 269/307

[58] Field of Search ..... 451/364, 388, 451/411; 125/35; 269/21, 303, 307

[56] References Cited

U.S. PATENT DOCUMENTS

| | | | |
|---|---|---|---|
| 3,294,392 | 12/1966 | Dunham | 269/21 |
| 3,627,299 | 12/1971 | Schwarze | 269/21 |
| 4,184,292 | 1/1980 | DeFazio et al. . | |
| 5,003,729 | 4/1991 | Sherby | 451/388 |
| 5,318,005 | 6/1994 | Mayer . | |
| 5,758,869 | 6/1998 | Redeker | 269/21 |
| 5,775,395 | 7/1998 | Wilkins | 144/286.5 |

FOREIGN PATENT DOCUMENTS 44 19 119 12/1995 Germany .

*Primary Examiner*—Shantese McDonald
*Attorney, Agent, or Firm*—Nixon & Vanderhye PC

[57] ABSTRACT

The bench for machining elongate objects such as strips of marble and the like comprises a generally boxlike body having a surface over which a portable profiling machine can be moved and a side comprising means for holding elongate objects or strips or the like in position by means of a plurality of pneumatic suction inlets which, by the action of low pressure, hold the elongate object stably during its machining.

8 Claims, 7 Drawing Sheets

BENCH FOR MACHINING ELONGATE OBJECTS SUCH AS STRIPS OF MARBLE AND THE LIKE

The present invention relates to a bench for machining elongate objects of marble-and the like.

Decorative strips of marble or the like requiring special machining for their shaping and polishing and other operations are in current use.

One difficulty encountered in the machining of objects of this kind on a craft or semi-craft basis, without resorting to large machines for industrial machining whose use for small work would be uneconomical, is that of how to fix a workpiece securely so that a portable-type moulding machine can work on it.

Clearly, this temporary fixing of objects of elongate shape or strips of this kind for the purpose of machining them must be stable and secure, and yet must not use clamps or equivalent means which would interfere with the machining processes, especially when portable profilers of known type are used.

It is therefore an object of the present invention to provide a machining bench for machining elongate objects or strips of marble or the like that have to be machined in the direction of their length without requiring the use of clamp-type fixing means or equivalents thereof The present invention provides a bench for machining elongate objects that comprises a generally boxlike body having a surface over which a portable profiling machine can be moved, and a side comprising means for holding strips or the like in position by means of a plurality of pneumatic suction inlets which, by the action of low pressure, hold the elongate object stably during its machining.

The present invention also provides an element for supporting the workpiece and positioning it correctly, with the aid of a pair of graduated elements arranged for the repeatable adjustment of the position of the workpiece and for ensuring it is parallel with the upper surface of the machining bench.

The present invention will now be described with reference to a currently preferred embodiment of the same, supported by the figures of the appended drawings, in which.

Referring to the abovementioned figures, the machining bench comprises a boxlike body 1 standing on feet 2, 3 and having an upper surface 4 over which a profiling machine can be moved, and a surface 5 against which the elongate objects or strips to be machined are leaned and on which they are retained.

Figure 1:
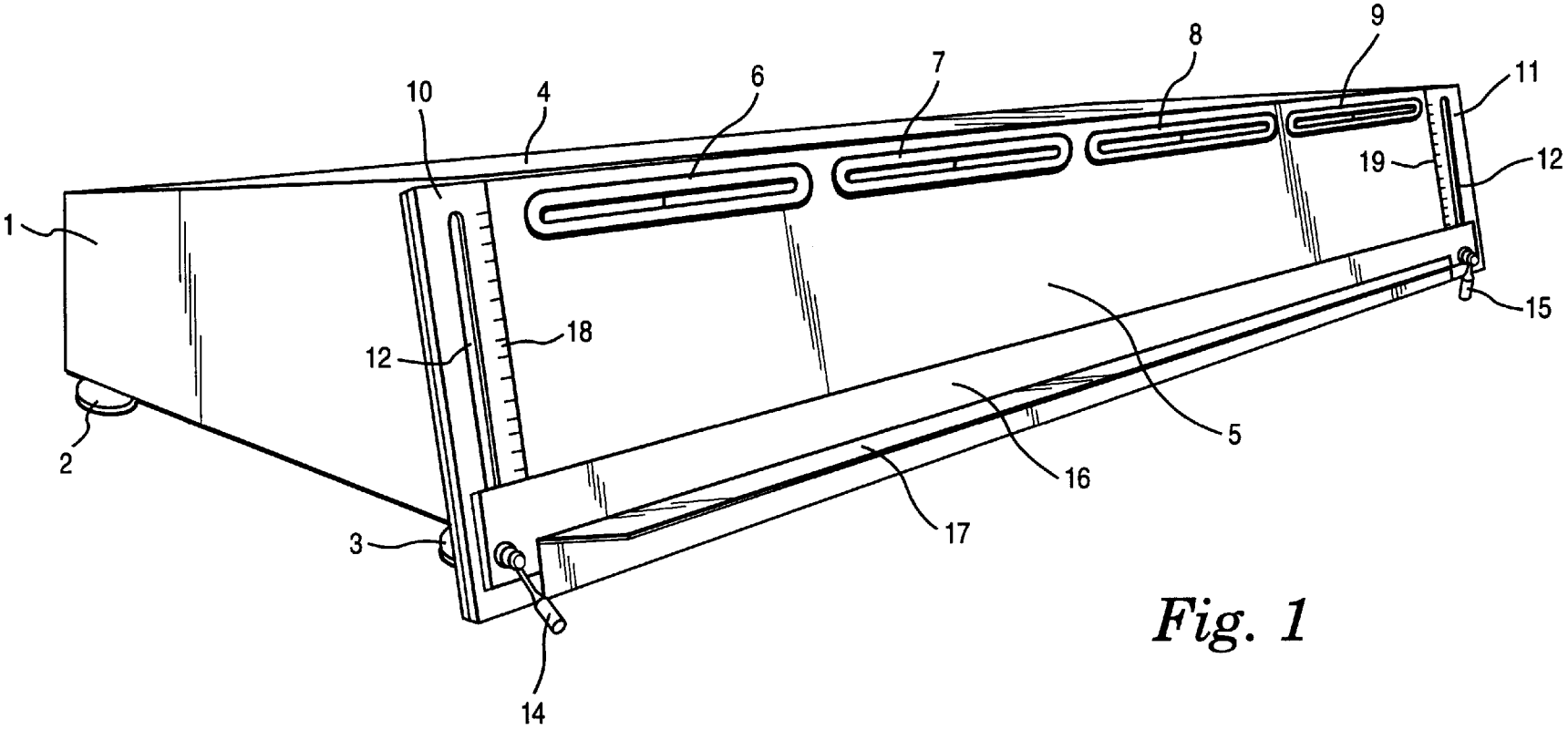
FIG. 1 is a perspective view of the machining bench according to the present invention.

As can be observed in FIG. 1, the surface 5 has a plurality of low-pressure pneumatic suction inlets 6, 7, 8, 9 running along the top dose to the edge formed by surfaces 4 and 5. At the ends of the surface 5 are two grooved elements 10, 11 having slots 12 in which clamping pins 13, visible in FIG. 6, can slide. These pins 13 are connected to levers 14, 15 for clamping in position a supporting bar 16 comprising a right-angled stiffening part 17.

Parts 10, 11 are conveniently provided with a millimetric or other similar scale 18, 19 to provide a positioning reference with respect to the upper surface 4 of the supporting bar 16 on which the workpieces are rested.

As can be seen, FIGS. 2 to 5 show the same view of the machining bench as in FIG. 1, on which various types of elongate objects or strips are positioned and fixed for machining.

Figure 2:
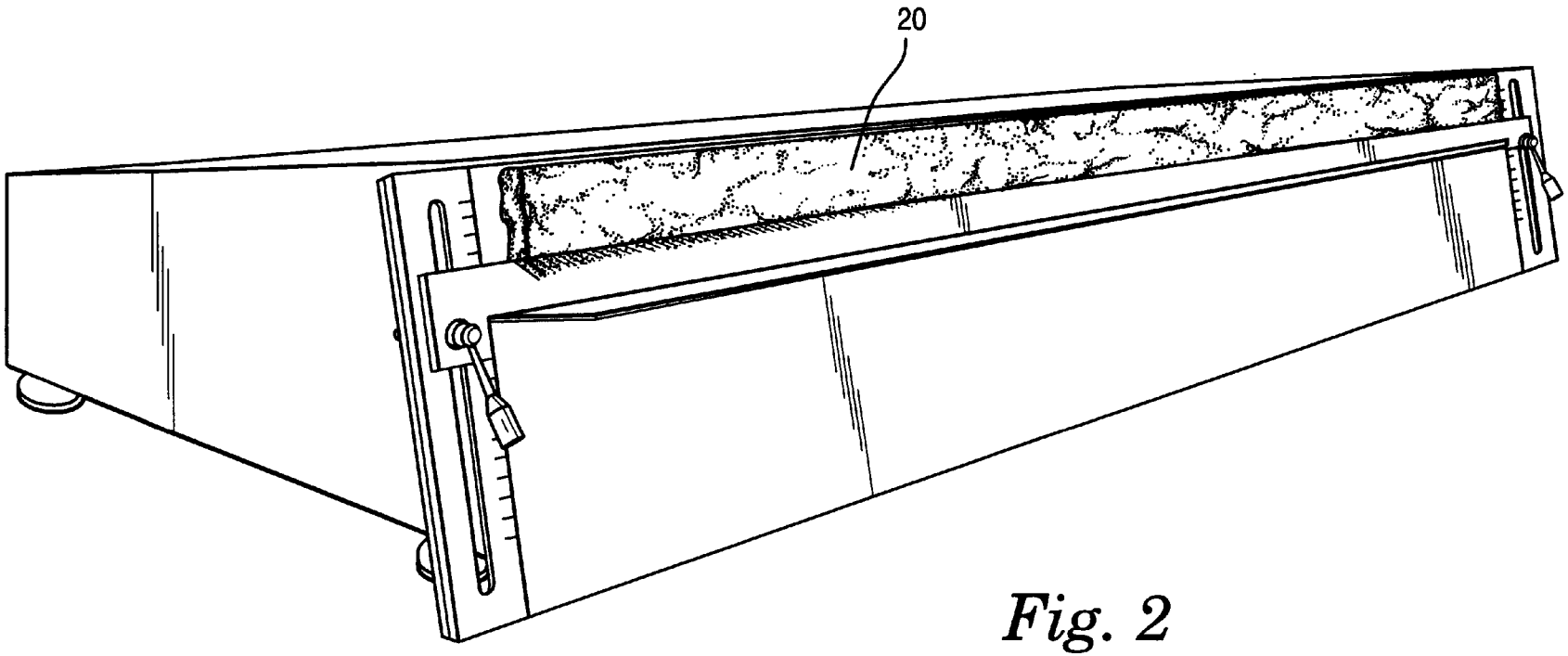
FIG. 2 is a perspective view of the machining bench shown in FIG. 1 on which an elongate object or strip extending roughly the full length of the machining stroke is fixed for machining.
Figure 3:
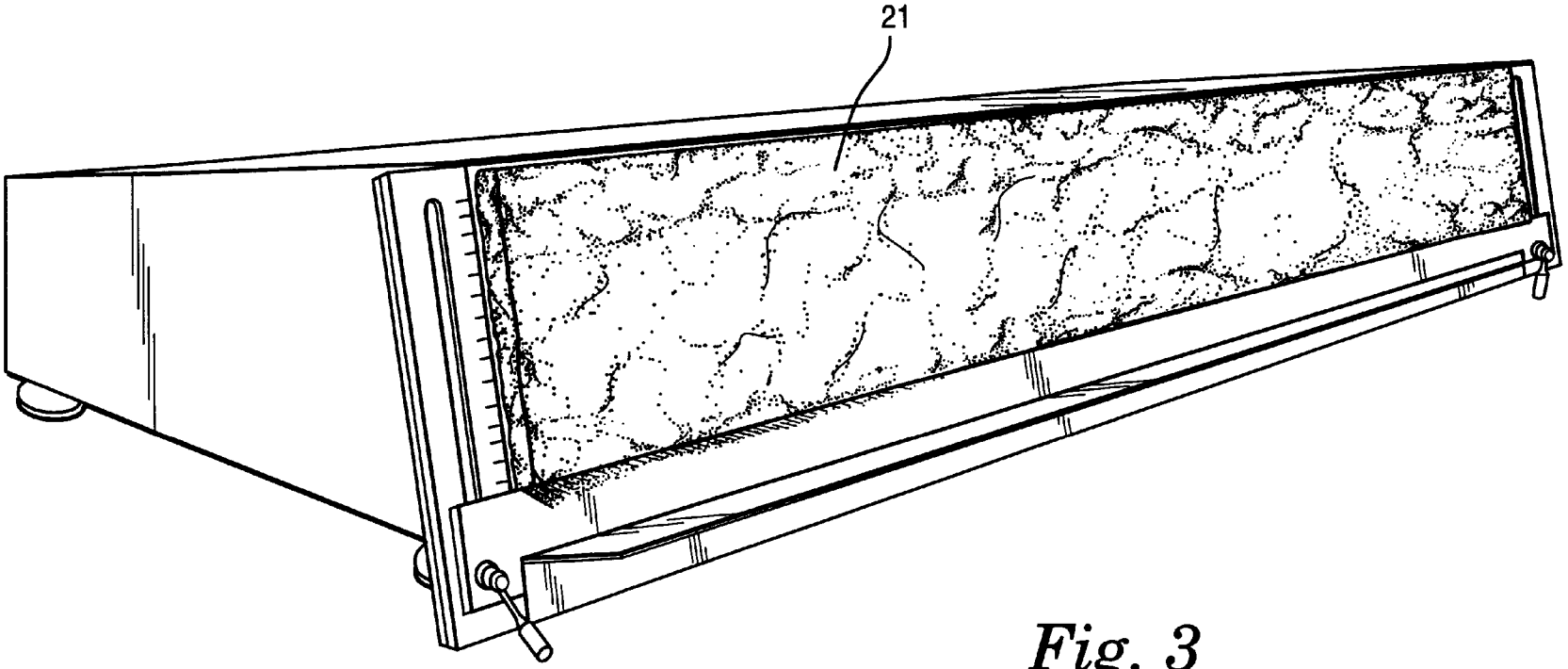
FIGS. 3 and 4 are views similar to FIG. 1 of the machining bench, on each of which are fixed workpieces with different proportions to those of the strip object shown in FIG. 2.

More particularly, FIG. 2 shows the machining bench of the invention on which is positioned a strip object 20 of considerable longitudinal length; FIG. 3 shows the machining bench on which an elongate object or strip 21 of considerable extent both longitudinally and transversely is positioned.

Figure 4:
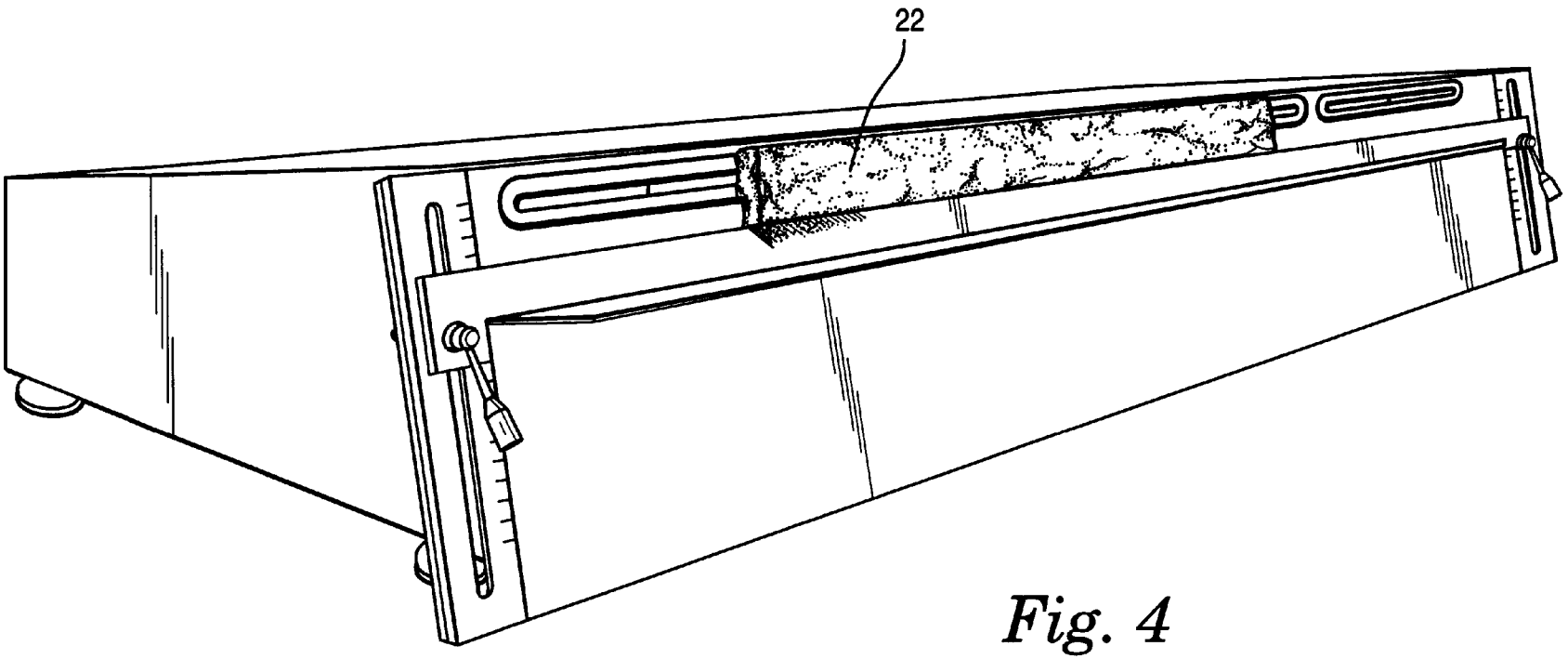
Figure 5:
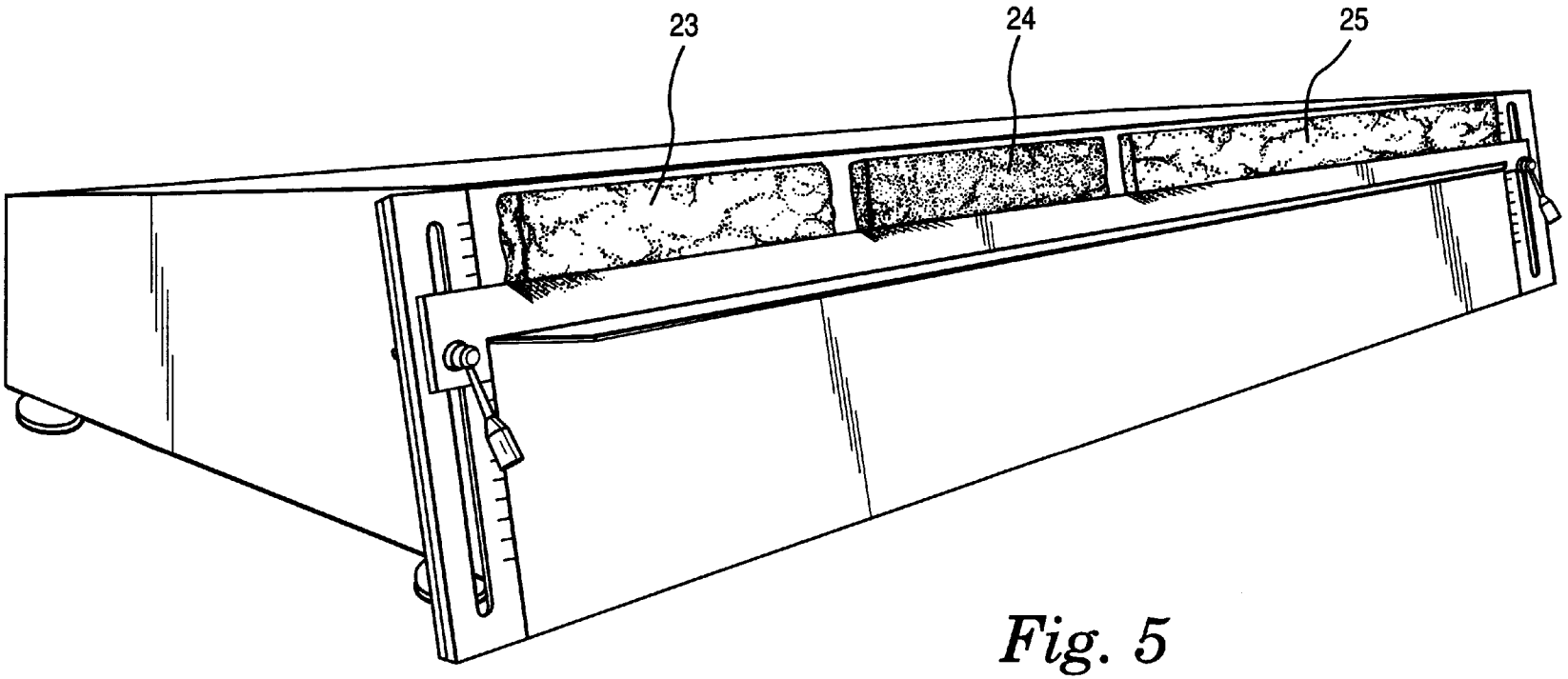
FIG. 5 shows the same view of the machining bench of FIG. 1, on which different types of strip object are fixed.

In FIG. 4 the workpiece 22 occupies only part of the maximum acceptable length of the elongate objects or strips for machining, and FIG. 5 shows a number of different elongate strip objects 23, 24, 25 for machining, varying in type and longitudinal length, secured simultaneously to the same machining bench.

Figure 6:
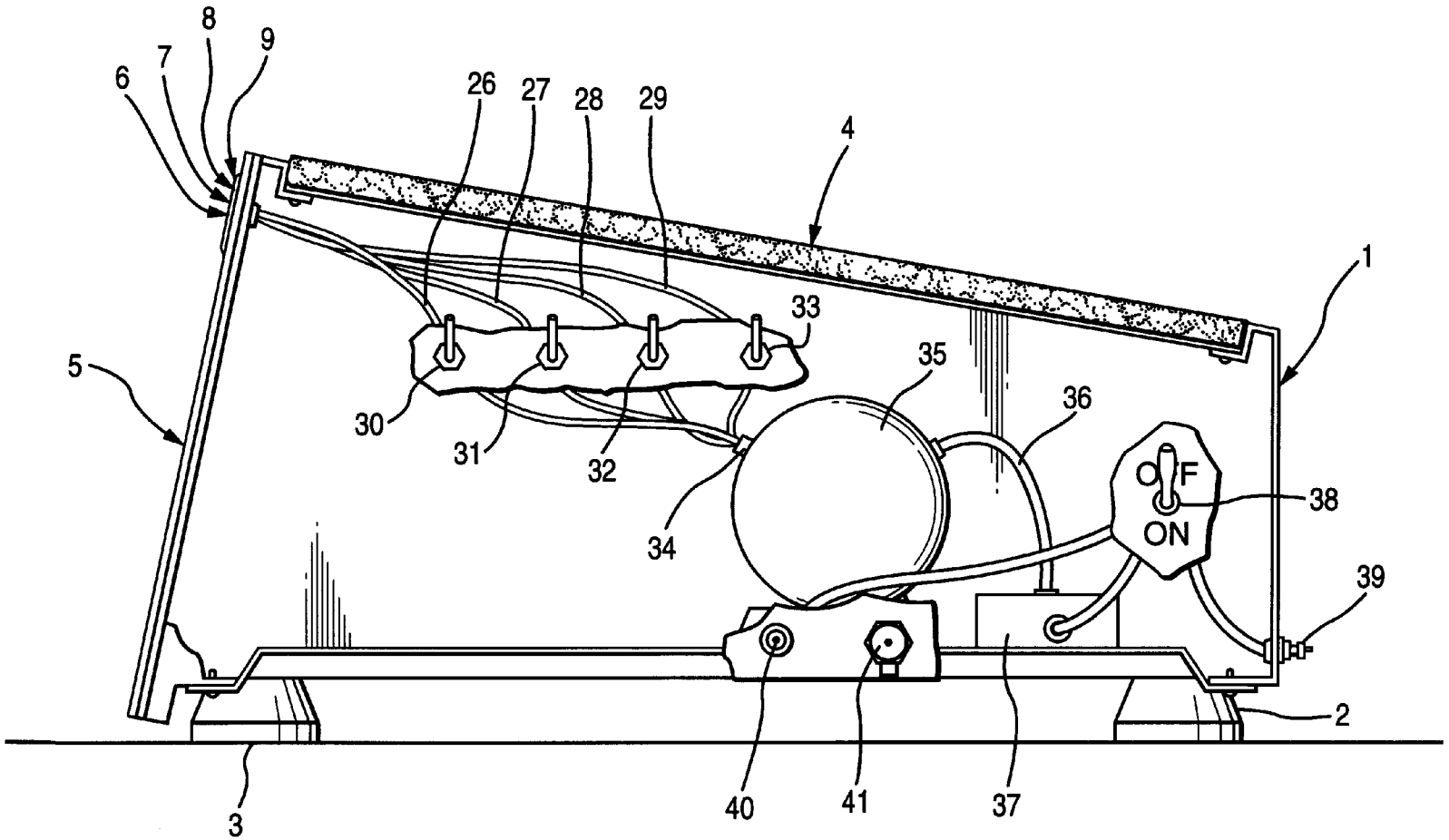
FIG. 6 is a side view of the machining bench according to the invention with parts removed to show the internal components.

FIG. 6 shows the low-pressure pneumatic suction inlets 6, 7, 8, 9 connected by tubes 26, 27, 28, 29. Each of these tubes has its own on-off valve 30, 31, 32, 33 which come together at 34 in a vacuum reservoir 35 well known in the art.

The reservoir 35 is connected by a tube 36 to a pneumatic vacuum generator employing a compressed-air ejector operating by the Venturi effect, marked 37 and well known per se, so it will not be described in further detail.

The vacuum generator 37 is connected via a valve 38 to a compressed air admission connector 39.

The reservoir 35 can, when necessary, be pressurized with compressed air through a connector 40. The reservoir 35 is also connected to a valve 41 for discharging water or other liquids, which may perhaps collect in it as a consequence of the grinding wheel operations, which are usually carried out with the aid of lubricating coolants, preferably water-based, which can be sucked in by the suction elements 6, 7, 8, 9.

Clearly, valves 30, 31, 32, 33 can be operated selectively to suit the dimensions of the work material in the longitudinal direction.

It should be noted, in addition, that the vacuum reservoir 35 helps in equalizing the suction action of the suction elements 6, 7, 8, 9.

Figure 7:
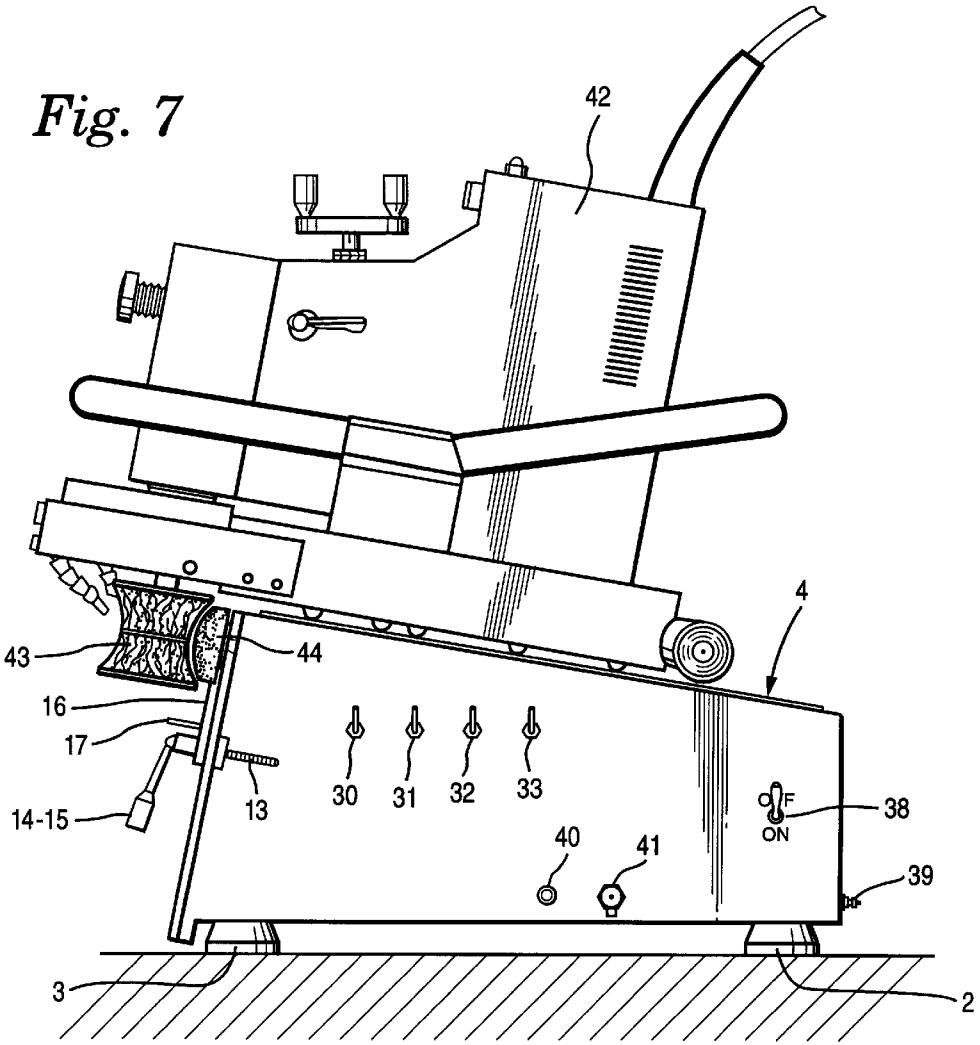
FIG. 7 is a side view of the machining bench according to the invention in conjunction with a typical profiling machine.

With reference to FIG. 7, the machining bench according to the invention is shown in combination with a profiling machine 42 which uses a grinding wheel 43 to machine a generic strip 44 while the latter is held in position.

The present invention has been described with reference to one currently preferred embodiment thereof, but it will be understood that alterations and modifications can be made in practice by those skilled in the art without departing from the scope of protection of the present industrial property document.

What is claimed is:

1. Bench for machining elongate objects, characterized in that it comprises a generally boxlike body having a surface over which a portable profiling machine can be moved and a side comprising means for holding elongate objects in position by means of a plurality of pneumatic suction inlets which, by the action of low pressure, hold the elongate object stably during its machining.

2. Machining bench according to claim 1, characterized in that the pneumatic suction inlets are elongate in the direction of the length of the marble strip or strips to be machined.

3. Machining bench according to claim 2, characterized in that the pneumatic suction inlets are connected to a vacuum reservoir via tubes.

4. Machining bench according to claim 3, characterized in that said tubes are fitted in an intermediate position with valve means for the selective activation or deactivation of one or more of the pneumatic suction inlets.

5. Machining bench according to claim 1, characterized in that the vacuum reservoir is connected to a vacuum source consisting of a Venturi-effect ejector activated by compressed air.

6. Machining bench according to claim 1, characterized in that the vacuum reservoir is fitted on its underside with a valve for discharging liquids that may collect inside the vacuum reservoir.

7. Machining bench according to claim 1, characterized in that the vacuum reservoir is connected via a valve to a connector for pressurization.

8. Machining bench according to claim 1, characterized in that it is arranged to operate in combination with a portable profiling machine equipped with a lubricated and cooled grinding wheel.

* * * * *